US005409521A

United States Patent [19]

Featherstone et al.

[11] Patent Number: 5,409,521

[45] Date of Patent: Apr. 25, 1995

[54] SLAG GRANULATION

[75] Inventors: William B. Featherstone, Guisborough; Derek Macauley, High Coniscliffe, Nr. Darlington, both of England

[73] Assignee: Davy McKee (Stockton) Limited, Cleveland, United Kingdom

[21] Appl. No.: 199,309

[22] PCT Filed: Sep. 8, 1992

[86] PCT No.: PCT/GB92/01635

§ 371 Date: Mar. 2, 1994

§ 102(e) Date: Mar. 2, 1994

[87] PCT Pub. No.: WO93/06250

PCT Pub. Date: Apr. 1, 1993

[30] Foreign Application Priority Data

Sep. 17, 1991 [GB] United Kingdom ..... 9119788

[51] Int. Cl.[6] ..... C21B 3/08

[52] U.S. Cl. ..... 75/334; 75/333; 425/8

[58] Field of Search ..... 75/334, 333; 264/8; 425/8

[56] References Cited

U.S. PATENT DOCUMENTS

| | | | |
|---|---|---|---|
| 3,721,511 | 3/1973 | Schlienger | 425/8 |
| 4,059,372 | 11/1977 | Barannik et al. | 425/8 |
| 4,256,677 | 3/1981 | Lee | 264/8 |
| 4,373,883 | 2/1983 | Tachimoto et al. | 425/8 |
| 4,909,837 | 3/1990 | Hansen et al. | 264/8 |
| 5,259,861 | 11/1993 | Yeh et al. | 75/334 |

*Primary Examiner*—Scott Kastler

*Attorney, Agent, or Firm*—Fay, Sharpe, Beall, Fagan, Minnich & McKee

[57] ABSTRACT

A granulator comprises a rotary atomiser (1) on to which the molten material to be granulated is poured in a stream. The rotation of the atomiser (1) causes the molten material to be ejected therefrom in the form of globules. No fluid jets are used to break up the molten material. The globules pass through an enclosure (6) and partially freeze to form granules which are collected in an annular trough (10). A gas is injected into the trough (10) to induce a circumferential movement of the granules within the trough towards at least one exit from the trough (10).

16 Claims, 2 Drawing Sheets

SLAG GRANULATION

This invention relates to a method of, and apparatus for, granulating a molten material. The material may be a metal, such as iron; a metal oxide, such as titanium oxide; a non-metal, such as slag generated as a by-product of a metals production process; or a mixture thereof. The invention is particularly applicable to the granulation of slag tapped from an iron blast furnace. The granulated slag can be used as a Portland cement substitute in the manufacture of concrete.

GB-B-2148330 discloses an apparatus and method for the granulation of slag. The granulator includes a rotary atomiser located within an enclosure. The base of the enclosure is in the form of a hopper containing a fluidised bed. In use, a stream of molten slag is poured on to the atomiser which is rotated at a speed such that the slag is ejected from the atomiser as a sheet or ribbon. Air jets from nozzles surrounding the atomiser impinge upon the sheet or ribbon and break it up into granules and impart an upward motion to them. The granules then fall towards the base of the enclosure where they pass through a countercurrent stream of secondary air and then enter into the fluidised bed.

This apparatus and method suffer from the disadvantage of the need to provide the air jets which impinge upon the sheet or ribbon to break it up into granular form. A considerable input energy requirement is necessary to provide air jets of sufficient force to break up the sheet or ribbon of slag and provide upward motion to the granules.

It is known from DE-A-2211682 to use an atomiser which includes a rapidly rotating plate to granulate molten slag without the necessity of employing air jets to break up the slag ejected from the rotating plate. In the disclosure of this German patent application, a substantially horizontal refractory-lined plate is rotated about a vertical axis in an enclosure. A stream of molten slag is poured on to the rotating plate and it is flung off the plate in the form of droplets. The droplets impinge against an inner wall of the enclosure and roll alarm a conically converging lower part of the wall to an exit point below the atomiser.

It is considered that this form of granulator is unreliable because it depends on the granules rolling down the inner wall of the enclosure to the exit point. If some granules stick to the wall, they prevent others from rolling down the wall and a build up of hardened granules on the wall soon occurs.

An object of the present invention is to provide a method of, and apparatus for, granulating molten material in which the disadvantages of the prior art arrangements are overcome.

According to a first aspect of the invention, a granulator comprises an enclosure; a rotary atomiser disposed within the enclosure; means for delivering molten material to the atomiser so that, in use, the material is broken into globules without the use of fluid jets and the globules are dispersed within the enclosure; an annular open-topped trough surrounding the atomiser to collect the granules formed from the at least partially frozen globules; and means for injecting gas into the trough to induce a circumferential movement of the granules in the trough towards at least one exit from the trough.

The trough surrounding the atomiser collects and cools the granules, forming a mobile bed of granulate in the process. The circumferential motion of the bed is brought about by gas, normally air, which is injected at a small angle to the horizontal into the bed through a slotted plate or gas distributor. The granulate bed moves circumferentially around the trough to one or more exits from the trough.

Granulation may start with no material in the trough, in which case a granulate bed is gradually built up, or a bed of cooled granulate from a previous run may be left in the trough to assist in the cooling process. The motion of the bed serves to encourage heat transfer between hot granulate and the injected gas and between hot and cold granulate. In addition, the bed motion acts to prevent re-agglomeration of the granules.

The design of the slotted plate and trough allows relatively high gas velocities through the slots to promote the circumferential motion. At the same time, the depth of the granulate bed is such that these high slot velocities are dissipated in the bed resulting in relatively low superficial gas velocities through the bed. The advantage of this arrangement is that a large range of particle sizes can be dealt with whilst avoiding significant elutriation and maintaining a relatively dense bed.

In certain applications, it is possible to modify the circumferential granulate motion towards the trough exits by use of a slightly inclined trough base.

The rotary atomiser conveniently comprises a thick disc of refractory material having a shaped top surface which promotes the desired slag droplet trajectory. The top surface may be dished to a greater or lesser extent depending upon desired trajectory, slag flow rate, cup speed range specification and desired particle size range. The device is rotated about a vertical axis by means of an electric motor which is located under appropriate covers beneath the device. The speed of rotation of the device is controlled as a function of slag flow rate, higher flows requiring higher rotational speeds to maintain droplet trajectory and size distribution. For this reason, the electric motor is driven by a variable speed drive (inverter).

According to a second aspect of the invention, in a method of granulating a molten material, a stream of the molten material is delivered to a rotating atomiser disposed within an enclosure; the speed of rotation of the atomiser is such that the molten material is ejected from the atomiser in the form of globules without the use of fluid jets; the passage of the globules within the enclosure cause them to at least partially freeze to form granules; the granules are collected in an annular open-topped trough surrounding the atomiser; and gas is injected into the trough to induce a circumferential movement of the granules in the trough towards at least one exit from the trough.

The globules of molten material ejected from the rotating atomiser fly outwardly towards the surrounding walls of the enclosure. The paths taken by the globules depend to a certain extent on the size of the globules. The globules spread out in the vertical plane as well as in the horizontal plane. The globules thus become in contact with the air in the enclosure and heat transfer between the globules and the air during the movement of the globules cause the globules to at least partially solidify to form granules. Some of the granules fall directly into the annular trough, while others will first impinge against the side wall of the enclosure before falling into the trough. To this end, it is desirable for the side wall of the enclosure to include a part which is at a higher level than the top of the trough, said higher part being of annular form with the lower end thereof leading to the top of the trough. This part of the side wall is conveniently liquid cooled such as by circulating liquid in a jacket mounted on the rear of the wall. Alternatively, the part of the side wall may have downwardly directed openings therein, and means are provided for directing cooling gas through the openings into the enclosure. The cooled wall or the air directed through the openings in the wall serve to prevent granules from sticking to the wall and the granules leave the wall and fall into the trough.

Some of the other globules/granules ejected from the atomiser will fall short of the trough and, preferably, an inclined surface extends downwardly from the rotary atomiser to the adjacent top edge of the trough. This surface conveniently has openings in it and gas is directed through the openings to the upper side of the surface. The gas and the inclined surface encourage the granules deposited on the surface to move into the trough.

It is desirable that means are provided to control the operating temperature within the enclosure so that, for example, a predetermined exit gas temperature is not exceeded. For example, an exit gas temperature not exceeding 400° C. may be desired. The operating temperature will depend to some extent on the rate at which the molten material is supplied to the atomiser. If, for any reason, the flow rate of the molten material increases suddenly, the exit gas temperature may exceed the desired level. To this end, the means to control the exit gas temperature may comprise sprays or atomisers for introducing a water mist into the enclosure. The water mist serves to remove heat from the enclosure by evaporation and it reduces the temperature of the air in the enclosure. The water mist is totally evaporated and it does not wet any surface within the enclosure nor does it wet the granulated product. A simple control circuit is employed which compares the actual temperature in the enclosure with the predetermined desired temperature in the enclosure and adjusts the quantity of water mist applied to the enclosure accordingly. It must be emphasised that the water mist only serves to control the operating temperature and it does not assist in the break up of the molten material in the globules.

BRIEF DESCRIPTION OF THE DRAWINGS

In order that the invention may be more readily understood, it will now be described, by way of example only, with reference to the accompanying drawings, in which.

A granulator for granulating slag which is a by-product from a blast furnace consists of a rotary atomiser having a duct along which molten slag is passed and poured on to the atomiser, an annular trough surrounding the atomiser and an enclosure in which the atomiser and the trough are located.

Figure 1:
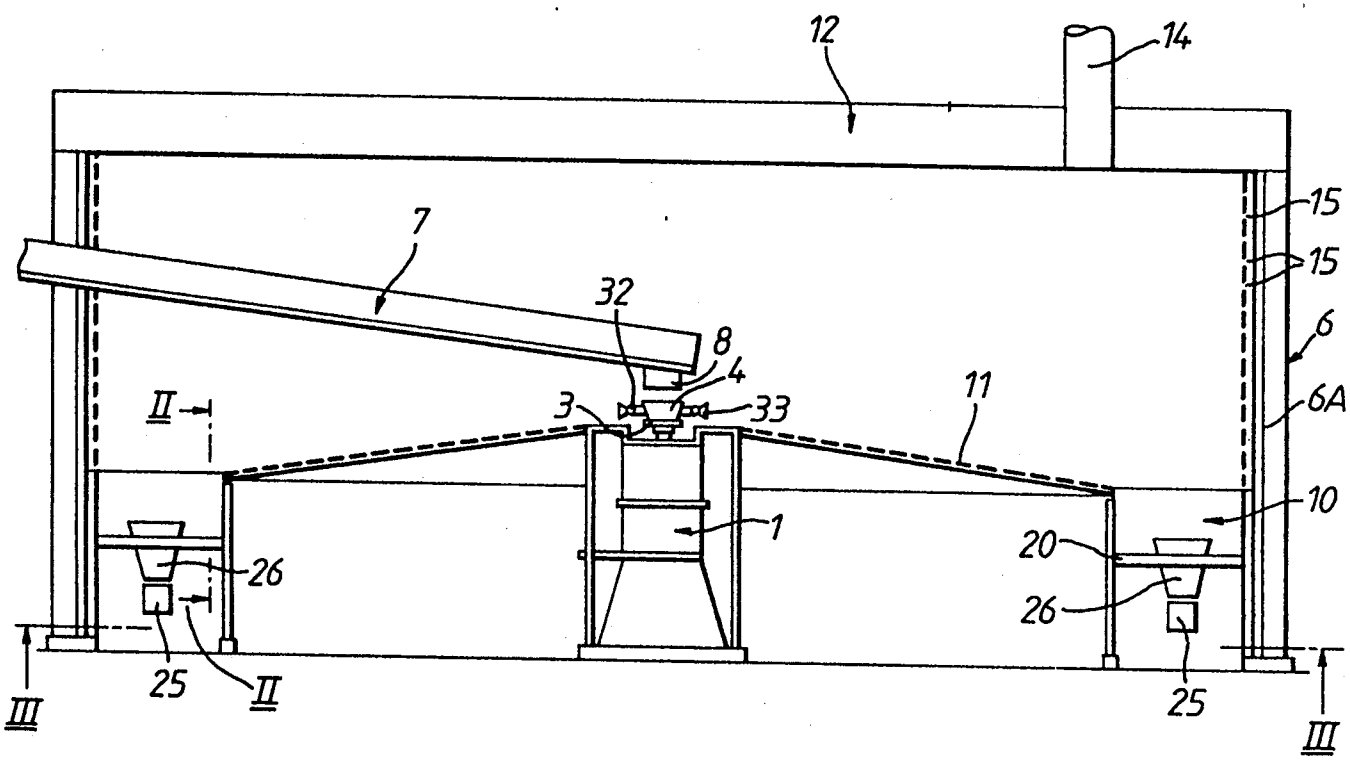
FIG. 1 is a sectional elevation through apparatus in accordance with the invention.

Referring particularly to FIG. 1, the rotary atomiser (1) comprises a stationary electric motor driven by, for example, a variable speed drive and having a vertical drive shaft. Mounted on the drive shaft is a flange (3) supporting a refractory dish or cup (4). The dish or cup has an upwardly facing concave surface and it is rotated about a vertical axis. The speed of rotation of the dish or cup can be varied. The atomiser is located within a generally cylindrical enclosure (6) and a feed duct (7) extends from outside the enclosure to a position above the atomiser (1). An outlet nozzle (8) permits molten slag flowing down the duct (7) to fall as a stream on to the concave surface of the cup (4). Surrounding the atomiser (1) there is an annular trough (10) and the top of the trough is at a lower level than the cup (4). A frusto-conical surface (11) extends downwardly from the rotary atomiser to the adjacent top edge of the trough. The part (6A) of the side wall, which is at a higher level than the top of the trough, has its lower end leading to the top of the trough. The enclosure is covered by a top structure (12) through which extends at least one discharge pipe (14). The part (6A), of the side wall of the enclosure may have a water jacket mounted on the outside thereof with provision for cooling liquid to be circulated through the jacket in order to cool the wall. However, in the arrangement shown, this part of the side wall has downwardly directed openings (15) therethrough and a hollow casing behind the wall enables a cooling gas, usually air, to be directed through the openings into the enclosure. The flow of air is downwardly towards the trough (10). Similarly, the frusto-conical surface (11) has openings therethrough and a casing below the surface enables gas, usually air, to be directed through the openings to the upper side of the surface. The direction of the air flow through the openings is towards the trough (10).

Figure 2:
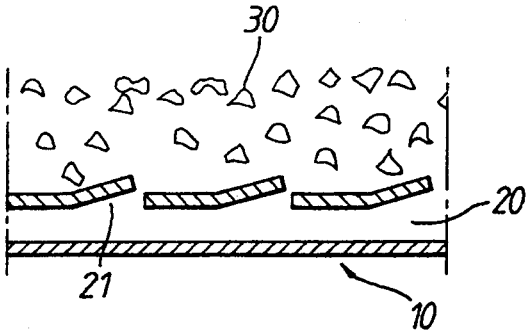
FIG. 2 is a sectional elevation on the line II—II of FIG. 1.
Figure 3:
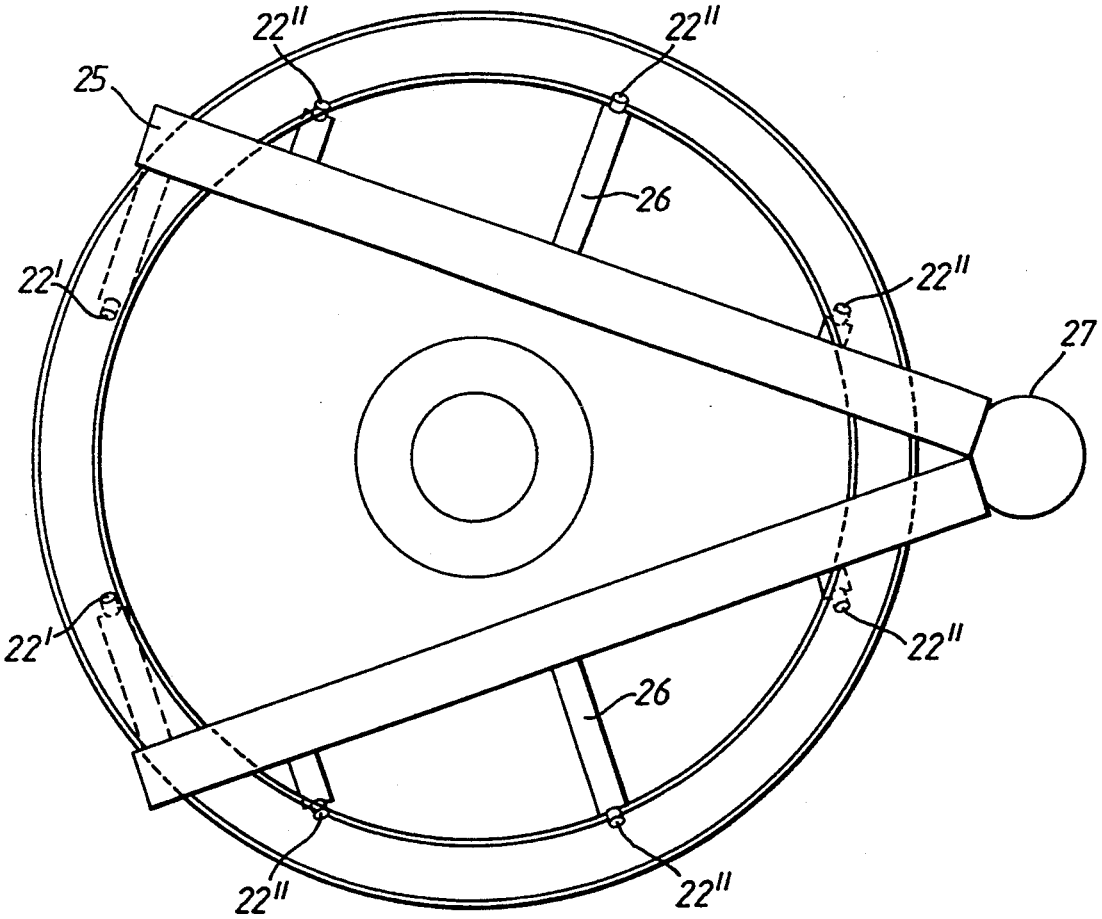
FIG. 3 is an inverted plan on the line III—III of FIG. 1.

Referring now to FIGS. 2 and 3 in particular, it can be seen that the base of the trough (10) comprises a wind box (20) which is supplied with air under pressure from a source (not shown). The air is expelled through slots (21) formed in the top of the box. The slots (21) are inclined at an angle of up to 25° to direct the air expelled from the air box in a single circumferential direction around the trough. There are a number of extraction points (22) located at various positions around the circumference of the trough. In the arrangement shown, eight extraction points are provided. Each extraction point (22) consists either of a conduit (22') which extends through the wind box (20) into the bottom of the trough or a hatch (22'') in a side wall of the trough. The lower end of each conduit (22') or each duct (22'') is positioned above one or other of a pair of conveyor belts or drag link conveyors (25) either directly or via inclined chutes (26). The conveyors may converge towards a single collection station (27).

In use, molten slag is allowed to flow down the duct (7) and fall as a stream on to the cup (4) of the atomiser (1) which is rotating at a speed usually between 750 rpm and 1200 rpm depending on slag flow rate. (Though speeds above this range are possible if required). The slag is ejected outwardly from the rotating cup (4) in the form of globules which, spread out into the enclosure and heat transfer takes place between each globule and air within the enclosure to at least solidify the outer skin of the globule so that it becomes a granule. Many of the granules will fall directly into the trough (10) while other granules will impact the side wall (6A) before falling down the wall into the trough. Other granules will fall on to the surface (11) and the air flow through the openings in the surface cause the granules to move down the: surface into the trough. Air is passed from the wind box (20) through the slots (21) to provide a circulating air flow in the circumferential direction of the trough (10). The circulating air flow drives the granules (30) which are present in the trough around a part of the trough until the next exit (22) is reached. Many of the granules will leave the trough through the exit (22) but those that fail to leave through the exit will be moved on by the air flow from the wind box to the next exit (22) where an opportunity to exit from the trough occurs. The granules leaving the exits are deposited on the conveyors (25) and taken to the collection point (27). It is to be emphasised that the trough (10) contains a circumferentially mobile bed. The granules are moved around the trough by the air flow in the trough but, though relatively high air velocities are required to do this, air velocities in the bed are low, avoiding significant elutriation of smaller particles and maintaining a relatively dense bed.

The hot air generated in the enclosure passes out of the enclosure through the or each discharge pipe (14) and it can be used to advantage elsewhere in the plant. In order to keep the temperature of the air in the enclosure below a predetermined level, at least one system comprising a pipe (32) having a plurality of nozzles (33) connected to it is supported within the enclosure, conveniently adjacent to the cup (4). Water is circulated through the pipe to issue through the nozzles in the form of a very fine mist. As an alternative to conventional nozzles, air operated atomisers may be employed to produce the mist. The mist injected into the enclosure is evaporated by the heat present in the enclosure and the mist does not wet any of the surfaces inside the enclosure, but the evaporation of the water does reduce the air temperature within the enclosure. Thus, it is convenient to employ a control circuit (not shown) which detects the temperature of the air within the enclosure and compares it with a predetermined value. When the temperature of the air reaches the predetermined value, the mist is generated in the enclosure in order to reduce the temperature. In this way, the temperature should be reduced below the predetermined value.

We claim:

1. A granulator comprising an enclosure (6); a rotary atomiser (1) disposed within the enclosure; means (7) for delivering molten material to the atomiser so that, in use, the material is broken into globules without the use of fluid jets and the globules are dispersed within the enclosure; an annular open-topped trough (10) surrounding the atomiser to collect the granules formed from the at least partially frozen globules; and means (20, 21) for injecting gas into the trough to induce a circumferential movement of the granules in the trough towards at least one exit (22) from the trough.

2. A granulator as claimed in claim 1, in which the rotary atomiser (1) comprises a refractory member (4) on to which the molten material is poured, said member being rotatable about a vertical axis.

3. A granulator as claimed in claim 1, in which the side wall of the enclosure includes a part (6A) which is at a higher level than the top of the trough (10), said part being of annular form with the lower end thereof leading to the top of the trough.

4. A granulator as claimed in claim 3, in which said part of the side wall is liquid cooled.

5. A granulator as claimed in claim 3, in which said part (6A) of the side wall has downwardly directed openings (15) therein, and means are provided for directing cooling gas through the openings into the enclosure.

6. A granulator as claimed in claim 1, in which an inclined surface (11) extends downwardly from the rotary atomiser to the adjacent top edge of the trough.

7. A granulator as claimed in claim 6, in which said surface has openings therein and means are provided for directing gas through the openings to the upper side of the surface whereby, in use, said gas serves to direct granules deposited on the surface to the annular trough.

8. A granulator as claimed in claim 1, in which the base of the annular trough has apertures (21) therethrough, said apertures being directed such that, in use, with gas injected through the apertures into the trough, there is a circumferential gas flow in the trough.

9. A granulator as claimed in claim 1, in which the at least one exit from the trough is provided by a conduit (22') extending through the base of the trough.

10. A granulator as claimed in claim 1, including means (32, 33) for introducing a water mist into the enclosure to remove heat therefrom by evaporation.

11. A granulator as claimed in claim 10, in which the means for introducing the water mist comprise water sprays or air operated water atomisers.

12. A method of granulating a molten material, in which a stream of the molten material is delivered to a rotating atomiser disposed within an enclosure; the speed of rotation of the atomiser is such that the molten material is ejected from the atomiser in the form of globules without the use of fluid jets; the passage of the globules within the enclosure cause them to at least partially freeze to form granules; the granules are collected in an annular open-topped trough surrounding the atomiser; and gas is injected into the trough to induce a circumferential movement of the granules in the trough towards at least one exit from the trough.

13. A method as claimed in claim 12, in which a quantity of previously formed cooled granules are present in the trough to assist in heat transfer from hot granules collected in the trough.

14. A method as claimed in claim 12, in which the stream of molten material is poured on to a refractory member of the rotary atomiser, said member being rotated about a vertical axis.

15. A method as claimed in claim 12, in which the operating temperature within the enclosure is controlled by injecting water mist into the enclosure to remove heat therefrom by evaporation of the water mist.

16. A method as claimed in claim 12, in which the molten material is slag.

* * * * *